US008689775B2

(12) United States Patent
Eee

(10) Patent No.: US 8,689,775 B2
(45) Date of Patent: Apr. 8, 2014

(54) COMPOUND BOW

(76) Inventor: Chang Ho Eee, Incheon (KR)

( * ) Notice: Subject to any disclaimer, the term of this patent is extended or adjusted under 35 U.S.C. 154(b) by 542 days.

(21) Appl. No.: 12/953,587

(22) Filed: Nov. 24, 2010

(65) Prior Publication Data

US 2011/0120436 A1 May 26, 2011

(30) Foreign Application Priority Data

Nov. 26, 2009 (KR) ..... 10-2009-0115137

(51) Int. Cl.
*F41B 5/10* (2006.01)

(52) U.S. Cl.
USPC ..... 124/25.6; 124/900

(58) Field of Classification Search
USPC ..... 124/25.6, 900
See application file for complete search history.

(56) References Cited

U.S. PATENT DOCUMENTS 3,841,295 A 10/1974 Hunter
2002/0162546 A1 11/2002 Mugg
2006/0011181 A1* 1/2006 Andrews ..... 124/23.1

FOREIGN PATENT DOCUMENTS

WO 00/40916 A1 7/2000

* cited by examiner

*Primary Examiner* — Alvin Hunter
*Assistant Examiner* — Amir Klayman
(74) *Attorney, Agent, or Firm* — Berenato & White, LLC

(57) ABSTRACT

A compound bow comprises a bow handle that a user holds with his or her hand. A pair of bow blades are combined with both ends of the bow handle, of which at least one bow blade is rotatably combined with the bow handle. A pair of pulleys are rotatably combined with respective rear ends of the pair of the bow blades so as to rotate around a rotating axis of each pulley. A bow string extends between the pair of pulleys and is pulled for discharge of an arrow. A blade rotating unit rotates the bow blade and is rotatably combined with the bow handle, in order to adjust or release tension of the bow string by adjusting distance between the pair of the pulleys in the case of controlling the tension of the bow string or disjointing or repairing the bow.

16 Claims, 17 Drawing Sheets

COMPOUND BOW

CROSS-REFERENCE TO RELATED APPLICATIONS AND CLAIM TO PRIORITY

This application is related to application number 10-2009-00115137, filed Nov. 26, 2009, in the Republic of Korea, the disclosure of which is incorporated by reference and to which priority is claimed.

FIELD OF THE INVENTION

The present invention relates to a compound bow, and more particularly, to a compound bow that enables a user to easily pull a bow string when he or she pulls the bow string, and that increases a force of a discharged arrow during discharge of the arrow, without consuming a big force by using an effect of a cam or a wheel, as well as enables him or her to disjoint, repair or re-assemble the bow without special equipment, and to easily adjust tension of the bow string.

BACKGROUND OF THE INVENTION

In general, a compound bow enables a user to easily pull a bow string when he or she pulls the bow string, and that increases a force of a discharged arrow during discharge of the arrow, without consuming a big force by using an effect of a cam or a wheel. As a result, the compound bow shows very fast speed of the discharged arrow and very strong force thereof. Thus, the compound bow is widely used for hunting.

In the case of such a conventional compound bow as shown in FIG. 1, an upper blade 20 is combined on the upper portion of a handle 10 made of an aluminum material, and a lower blade 26 is combined on the lower portion thereof. Incision portions 21 and 27 that are cut open are formed on respective ends 22 and 28 of the upper blade 20 and the lower blade 26, and a cam unit is rotatably installed as eccentric shafts 70 between the incision portions 21 and 27.

The cam unit includes an upper cam 30 and a lower cam 36, and a bow string 50 is connected along the upper cam 30, the end 28 of the lower blade 26, and the lower cam 36. A first cable 40 and a second cable 46 cross with each other.

A cable guard 60 is installed in the width direction at one side of the central region of the handle 10, and a slide 66 that is movable on the cable guard 60 and into which the bow string 50 is inserted is installed on the cable guard 60.

The slide 66 is a device that pushes the first and second cables 40 and 46 in one direction in order to prevent a user from being blocked by the first and second cables 40 and 46 when he or she shoots the bow.

In the case of the conventional compound bow that is formed as described above, if the bow string 50 is pulled, the upper and lower cams 30 and 36 are made to rotate around the eccentric shafts 70, respectively. If the bow string 50 is pulled and then released so that portions of the biggest diameter around the respective eccentric shafts 70 pass a vertical state, an arrow can get a strong propulsive force by a strong elastic force that instantaneously returns to the original position.

By the way, the conventional compound bow has problems that tension of the bow string is not easily controlled during using the compound bow, and that equipment called a bow press having a specially large volume is needed in the case that there is a need to disjoint and repair the bow, to accordingly cause the bow not to be disjointed and repaired on site with no equipment.

SUMMARY OF THE INVENTION

To solve the above problems of the conventional art, it is an object of the present invention to provide a compound bow that enables a user to easily adjust tension of a bow string of the compound bow, and to freely disjoint and repair the compound bow with no special bow press equipment.

To achieve the above object of the present invention, there is provided a compound bow comprising:

a bow handle that a user holds with his or her hand;

a pair of bow blades that are combined with both ends of the bow handle, of which at least one bow blade is rotatably combined with the bow handle;

a pair of pulleys that are rotatably combined with respective rear ends of the pair of the bow blades so as to rotate around a rotating axis of each pulley;

a bow string that is formed between the pair of the pulleys and that is pulled for discharge of an arrow; and a blade rotating unit that rotates the bow blade that is rotatably combined with the bow handle, in order to adjust or release tension of the bow string by adjusting distance between the pair of the pulleys in the case of controlling the tension of the bow string or disjointing or repairing the bow.

Preferably but not necessarily, the pair of the bow blades are rotatably combined around rotating axes that are formed at both ends of the bow handle, and a pair of blade rotating units are provided to rotate the pair of the bow blades, respectively.

Preferably but not necessarily, the blade rotating unit comprises: a connection member of which the one end is combined with one end of the bow blade, and the other end is combined with one side of the bow handle; and a length control member that controls length of the connection member, wherein the length of the connection member that is formed between one end of the bow blade and the bow handle is controlled by the length control member.

Preferably but not necessarily, the one end of the connection member is combined with a pin that is formed in the width direction of each bow blade.

Preferably but not necessarily, the length control member comprises a winding unit that rotates an axis that is rotatably combined at one side of the bow handle and winds or releases the connection member that is combined with the axis on or from the axis.

Preferably but not necessarily, the winding unit of the length control member comprises: a worm wheel at the center of which the axis is combined; and a worm that rotates the worm wheel in which threads that are formed on the outer circumferential surface of the worm are tooth-engaged with gear teeth that are formed on outer circumferential surface of the worm wheel, and wherein the connection member comprises a belt whose one end is combined on one side of the bow blade that is extended forwards from the bow handle, and whose other end is combined on one end of the axis of the worm wheel and that is wound or released on or from the axis as the worm gear rotates.

Preferably but not necessarily, a rubber shock absorber that decreases a shock transferred to the bow after discharge of an arrow is provided in the belt.

Preferably but not necessarily, a shock-absorbing hole that decreases the shock of the bow is piercingly formed in the rubber shock absorber.

Preferably but not necessarily, a belt coupling groove that is piercingly formed transversely in the diameter direction from one side of the outer circumferential surface of the axis to the other side thereof is formed at one end of the axis of the worm wheel, so that the other end of the belt is fitted into the belt coupling groove.

Preferably but not necessarily, a belt fixing groove that communicates with the belt coupling groove and whose width is larger than that of the belt coupling groove is formed at the other side of the axis of the worm wheel, in which an end portion of the belt whose thickness is thicker than the other portion of the belt is safely mounted in the inside of the belt fixing groove so as not to be protruded outwards from the outer circumferential surface of the axis of the worm wheel.

Preferably but not necessarily, a winding unit of the length control member in a blade rotating unit according to another embodiment of the present invention, comprises: a ratchet gear at the center of which one end of an axial bolt that forms the axis is combined; and a pawl whose one side is tooth-engaged with gear teeth of the ratchet gear so that the ratchet gear rotates only in one direction, and wherein the connection member comprises a belt whose one end is combined on one side of the bow blade that is extended forwards from the bow handle, and whose other end is combined on one end of the axial bolt of the ratchet gear and that is wound or released on or from the axial bolt as the ratchet gear rotates.

Preferably but not necessarily, a spring is provided in the pawl so that the pawl is tooth-engaged with the gear teeth of the ratchet gear again after the pawl is released from the gear teeth of the ratchet gear according to rotation of the ratchet gear.

Preferably but not necessarily, a winding indicator on the edge of which figures are circumferentially engraved is formed in the ratchet gear so as to see a winding degree of the ratchet gear.

Preferably but not necessarily, one or more rubber shock absorber that decrease a shock transferred to the bow after discharge of an arrow is provided in the belt.

Preferably but not necessarily, a belt coupling groove that is piercingly formed transversely in the diameter direction from one side of the outer circumferential surface of the axial bolt to the other side thereof is formed in the axial bolt that forms the rotating axis of the ratchet gear so that the other end of the belt is fitted into the belt coupling groove.

Preferably but not necessarily, a belt fixing groove that communicates with the belt coupling groove and whose width is larger than that of the belt coupling groove is formed at one side on the outer circumferential surface of the axial bolt, in which an end portion of the belt whose thickness is thicker than the other portion of the belt is safely mounted in the inside of the belt fixing groove so as not to be protruded outwards from the outer circumferential surface of the axial bolt.

Preferably but not necessarily, the bow blade that is rotatably combined with the bow handle, comprises: a limb pocket whose one end is rotatably combined around a rotating axis that is formed at one end of the bow handle and that is extensively formed forwards from one end of the bow handle; and a bow limb whose one end is combined with the limb pocket and that is extensively formed backwards from the bow, and on the other end of which a rotating axis with which a pulley is combined is formed.

Preferably but not necessarily, an insertion groove is lengthily formed in the limb pocket so as to allow the front side of the bow limb to be inserted into the insertion groove.

Preferably but not necessarily, a coupling pin that is combined with one end of the belt is formed at one end of the front side of the limb pocket, in which a pin hole that is formed at one end of the belt is combined in one side of the coupling pin.

Preferably but not necessarily, a rubber shock absorber that decreases a shock transferred to the bow after discharge of an arrow is provided in the limb pocket.

Preferably but not necessarily, an arrowhead insertion hole into which an arrowhead is inserted so as to be disjointed from or combined with an arrow, and an arrowhead wing insertion portion that has one or more arrowhead wing insertion hole that is extended bilaterally from the arrowhead insertion hole and into which one or more arrowhead wings are inserted, are formed in the limb pocket.

Preferably but not necessarily, a notch insertion hole is formed in the limb pocket, so that a notch is inserted into the notch insertion hole so as to be easily replaced from an arrow.

Preferably but not necessarily, a hook portion is formed at the front end of the limb pocket so that the bow can be hung up on an external object.

Preferably but not necessarily, a blade rotating unit in a compound bow according to still another embodiment of the present invention, comprises: a cylinder whose one end is rotatably combined with one side of the bow handle, and that has an inner space to or from which fluid such as gas or oil is supplied or discharged; a piston that is placed in the inner space of the cylinder and that is moved in the lengthy direction according to a supply or discharge of the fluid to or from the cylinder; and a piston rod whose one end is fixedly combined with the piston and whose other end is extensively formed outwards from the cylinder through the other end of the cylinder, and that is rotatably combined with one side of the bow blade that is extended in the rear side of the bow handle.

Preferably but not necessarily, the bow blade that is rotatably combined with the bow handle, in a compound bow according to still another embodiment of the present invention, comprises: a limb pocket whose one end is rotatably combined on one end of the bow handle, and that is extensively formed at one end of the bow handle in the rear side of the arrow, and on the other end of which the other end of the piston rod is combined; and a bow limb whose one end is combined with the limb pocket and that is extensively formed backwards from the bow, and on the other end of which a rotating axis with which a pulley is combined is formed.

Preferably but not necessarily, according to still another embodiment of the present invention, a fluid supply unit is provided at one side of the cylinder, to supply or discharge the fluid such as gas or oil to or from the inner space of the cylinder.

Preferably but not necessarily, according to still another embodiment of the present invention, the fluid supply unit is a hydraulic oil pump.

Preferably but not necessarily, the blade rotating unit in a compound bow according to still another embodiment of the present invention, comprises: a worm gear that comprises a worm wheel whose axis is rotatably combined on one side of the bow handle and on the outer circumferential surface of which gear teeth are formed; and a worm on the outer circumferential surface of which threads are formed in which the worm is tooth-engaged with the gear teeth of the worm wheel to thereby rotate the worm wheel; and an arch portion that is extended downwards in the form of an arc from the front-lower surface of the bow blade and on the outer circumferential surface of which gear teeth that are tooth-engaged with the gear teeth of the worm wheel are formed.

Preferably but not necessarily, the blade rotating unit in a compound bow according to still another embodiment of the present invention, comprises: an arch portion that is extended downwards in the form of an arc from the front-lower surface of the bow blade and on the outer circumferential surface of which gear teeth are formed; and a worm that is formed at one side of the bow handle and on the outer circumferential surface of which threads that are tooth-engaged with the gear teeth of the arch portion are formed.

Preferably but not necessarily, the blade rotating unit in a compound bow according to still another embodiment of the present invention, comprises: an arch portion that is extended downwards in the form of an arc from the front-lower surface of the bow blade and on the outer circumferential surface of which gear teeth are formed; and a rotating wheel that is rotatably formed at one side of the bow handle and on the outer circumferential surface of which gear teeth that are tooth-engaged with the gear teeth of the arch portion are formed, to thereby rotate the arch portion according to rotation of the rotating wheel to thus rotate the bow blade.

Preferably but not necessarily, the blade rotating unit further comprising: a ratchet gear that is formed at one side of the bow handle and is formed coaxially at one end of the rotating wheel; and a pawl whose one side is tooth-engaged with gear teeth of the ratchet gear so that the ratchet gear rotates only in one direction.

Preferably but not necessarily, the blade rotating unit in a compound bow according to still another embodiment of the present invention, comprises: a worm gear that comprises a worm wheel whose axis is rotatably combined on one side of the bow handle; and a worm on the outer circumferential surface of which threads are formed in which the worm is tooth-engaged with the gear teeth formed on the outer circumferential surface of the worm wheel to thereby rotate the worm wheel, in which one side of the bow blade is combined on one side of the axis of the worm wheel to thus rotate the bow blade together as the worm wheel rotates.

A compound bow according to the present invention has an advantage that enables a user to easily adjust tension of a bow string of the compound bow, and to freely disjoint and repair the compound bow with no special press equipment, when he or she intends to control tension of the bow string, or to repair or dismantle the bow at a time when the bow is not in use.

BRIEF DESCRIPTION OF THE DRAWINGS

The above and other objects and advantages of the present invention will become more apparent by describing the preferred embodiment thereof in more detail with reference to the accompanying drawings in which.

DETAILED DESCRIPTION OF THE PREFERRED EMBODIMENT(S)

A compound bow according to respective preferred embodiments of the present invention will be described with reference to the accompanying drawings, FIGS. 2 to 17.

First, a compound bow according to a first embodiment of this invention will be described below.

Figure 1:
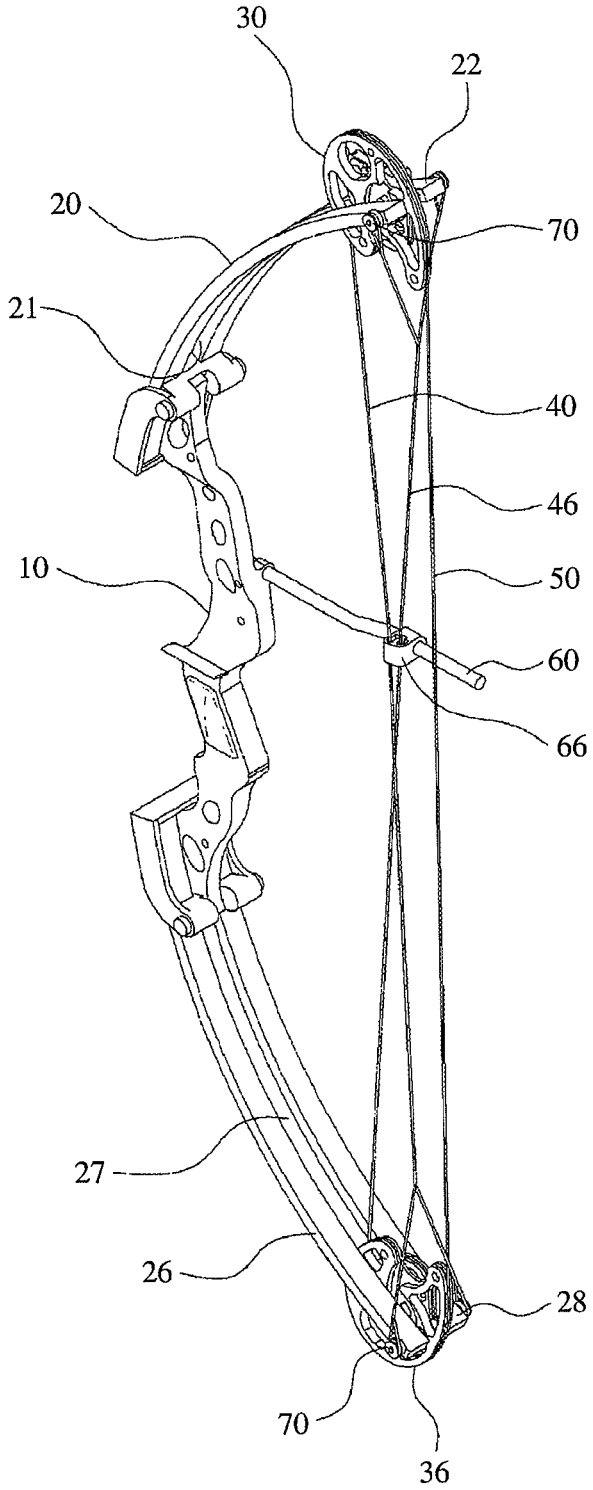
FIG. 1 (PRIOR ART)
FIG. 1 is a perspective view illustrating a conventional compound bow.
Figure 2:
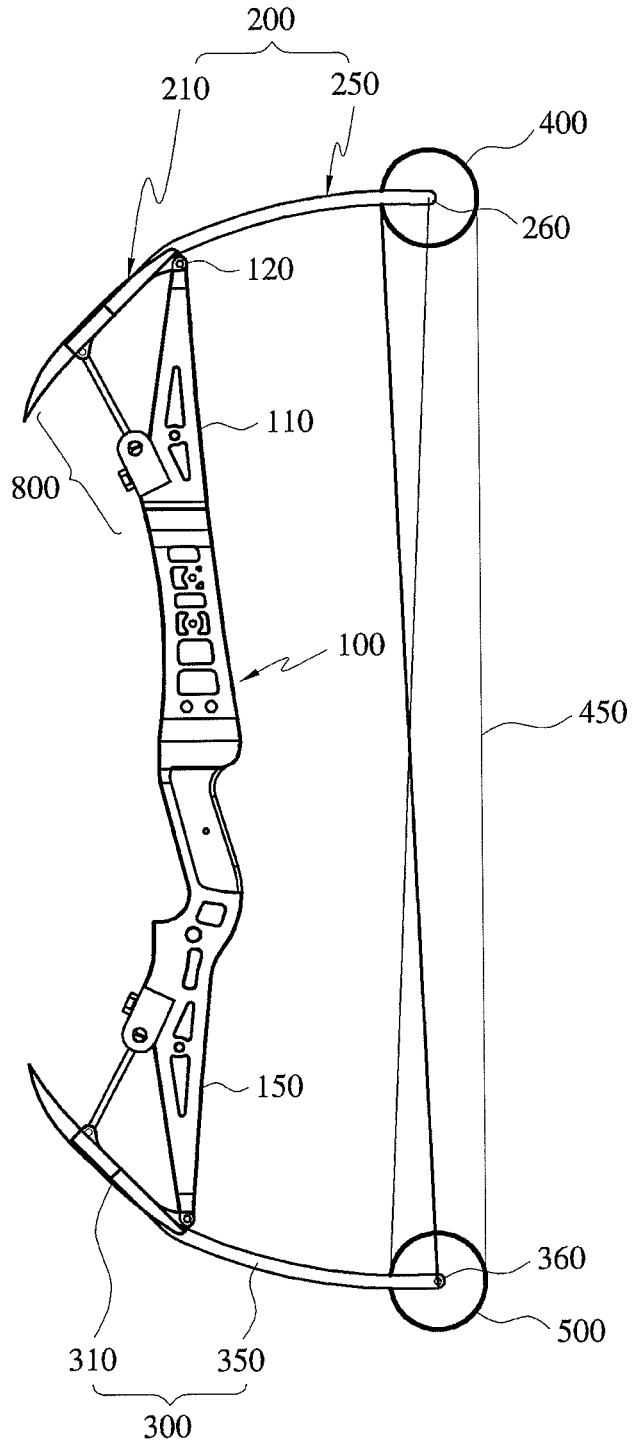
FIG. 2 is a plan view showing a compound bow according to a first embodiment of this invention.
Figure 3:
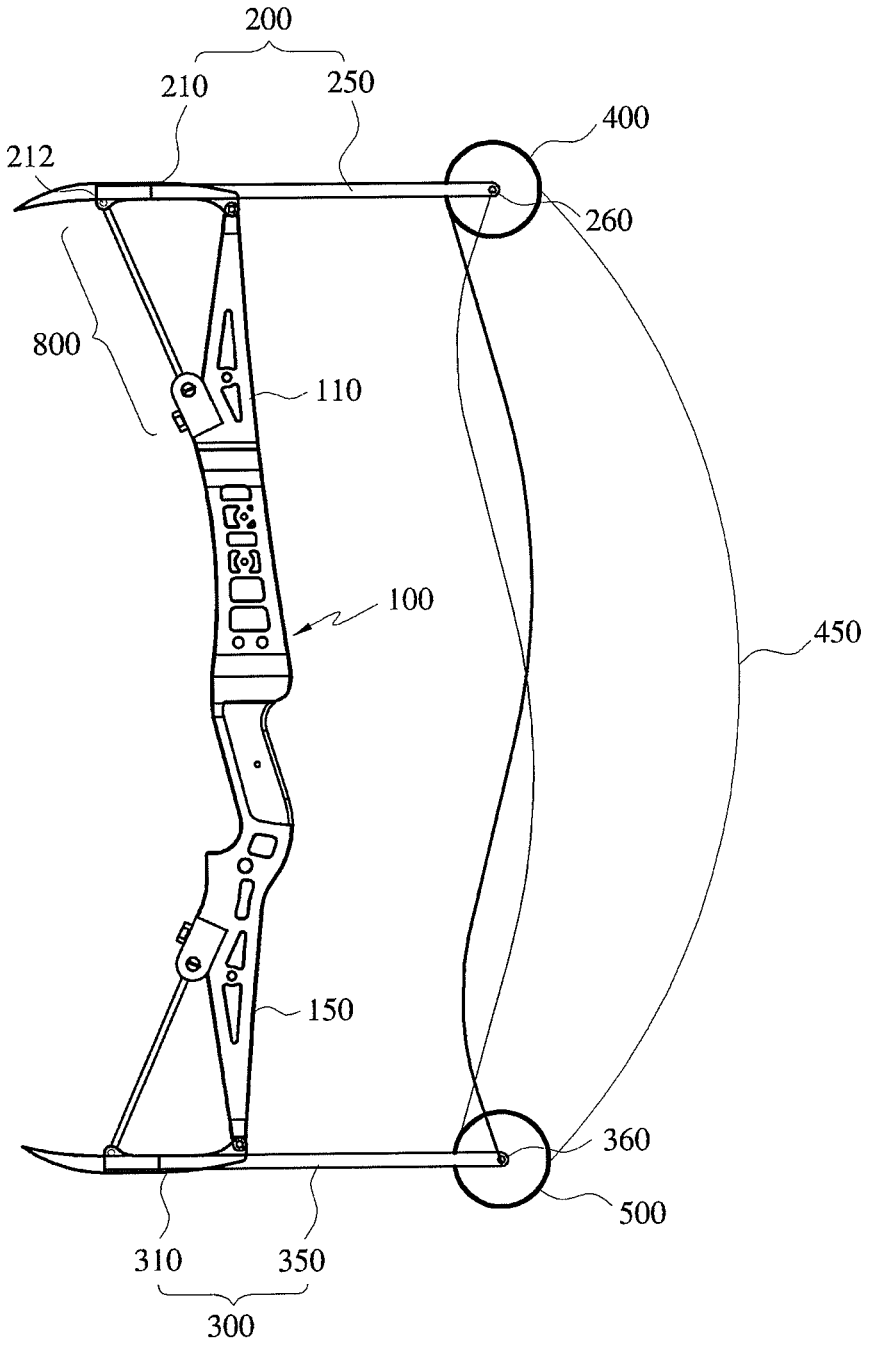
FIG. 3 is a plan view showing the compound bow of a state where tension of a bow string has been removed from the compound bow of FIG. 2.
Figure 4:
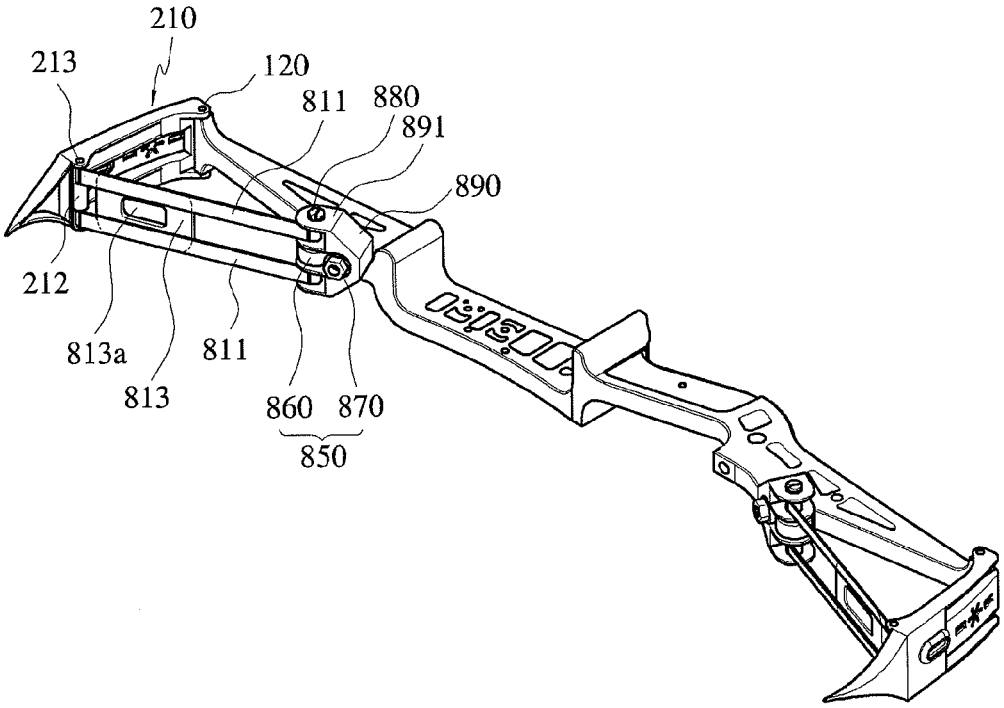
FIG. 4 is a perspective view showing a state where a limb pocket and a bow handle have been assembled in the first embodiment of this invention.
Figure 5:
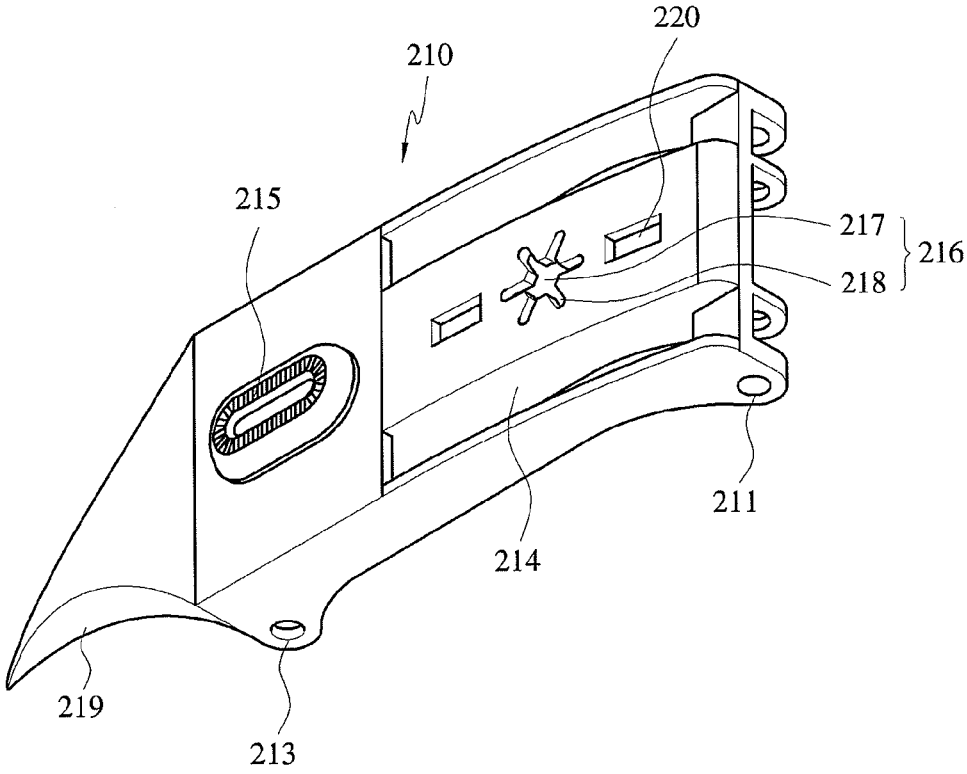
FIG. 5 is a perspective view of the limb pocket in the first embodiment of this invention.
Figure 6:
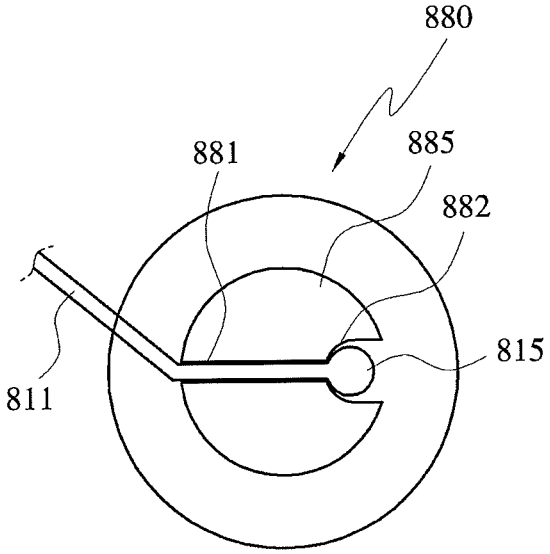
FIG. 6 is a cross-sectional view of an axis of a worm wheel in the first embodiment of this invention.
Figure 7:
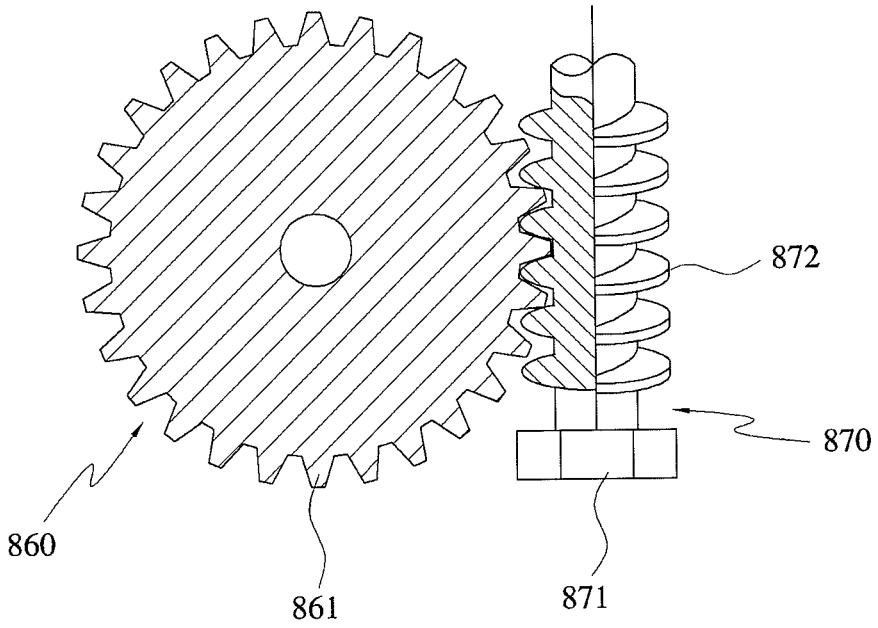
FIG. 7 is a diagram illustrating a coupling relationship between a worm and a worm wheel in the first embodiment of this invention.

FIG. 2 is a plan view showing a compound bow according to a first embodiment of this invention. FIG. 3 is a plan view showing the compound bow of a state where tension of a bow string has been removed from the compound bow of FIG. 2. FIG. 4 is a perspective view showing a state where a limb pocket and a bow handle have been assembled in the first embodiment of this invention. FIG. 5 is a perspective view of the limb pocket in the first embodiment of this invention. FIG. 6 is a cross-sectional view of an axis of a worm wheel in the first embodiment of this invention. FIG. 7 is a diagram illustrating a coupling relationship between a worm and a worm wheel in the first embodiment of this invention.

As illustrated in FIGS. 2 to 7, a compound bow according to a first embodiment of this invention includes: a bow handle 100 that a user holds with his or her hand; a pair of bow blades 200 and 300 that are rotatably combined with both ends of the bow handle 10; a pair of pulleys 400 and 500 that are rotatably combined with respective rear ends of the pair of the bow blades 200 and 300 so as to rotate around a rotating axis 260 or 360 of each pulley 400 or 500; a bow string 450 that is formed between the pair of the pulleys 400 and 500 and that is pulled for discharge of an arrow; and blade rotating units 800 that enable rotation of the pair of the bow blades 200 and 300 that are rotatably combined with both ends of the bow handle 10.

First, the bow handle 100 is a portion that a user of the bow holds with his or her hand during using the bow use, and rotating pins 120 are formed at the ends of the upper and lower portions 110 and 150 of the bow handle 100 so that the bow blades 200 and 300 are rotatably combined, respectively.

The pair of the bow blades 200 and 300 are rotatably combined on both ends of the bow handle 100, respectively, and are extensively formed in the front and rear sides of the bow handle 100, respectively. The pair of the bow blades 200 and 300 have an equal composition, respectively. The upper bow blade 200 includes a limb pocket 210 that is extended forwards at one end of the bow handle 100, and a bow limb 250 that is extended backwards at one end of the bow handle 100. The lower bow blade 300 is also formed of a limb pocket 310 and a bow limb 350. Hereinbelow, since the pair of the bow blades 200 and 300 are identical to each other, only the upper bow blade 200 will be described.

The bow blade 200 includes a limb pocket 210 that is extensively formed forwards from the bow handle 100, and a bow limb 250 that is combined with the limb pocket 210 and that is extensively formed backwards from the bow handle 100.

As illustrated in FIG. 5, a rotating pin hole 211 into which a rotating pin 120 formed at one end of the bow handle 100 is inserted is formed at the rear end of the limbs pocket 210, so as to be rotatably combined on one end of the bow handle 100, and a coupling pin hole 213 into which a coupling pin 212 that is combined with one end of a belt 811 to be described later is inserted is formed at the front end of the limb pocket 210 that is extensively formed forwards from an arrow (that is, in an arrow traveling direction). In addition, two insertion grooves 214 are lengthily formed in parallel with each other in the limb pocket 210, so that the front side of the bow limb 250 can be inserted into the two insertion grooves 214. Since the front side of the bow limb 250 can be inserted into the two insertion grooves 214, the end of the front side of the bow limb 250 is supported by the lower portion of the front end of the limb pocket 210. An arrowhead insertion hole 217 into which an arrowhead is inserted so as to be disjointed from or combined with an arrow, and an arrowhead wing insertion portion 216 that has one or more arrowhead wing insertion hole 218 which is extended bilaterally from the arrowhead insertion hole 217 and into which one or more arrowhead wings are inserted, are formed at the central portion of the limb pocket 210. Likewise, a notch insertion hole 220 is formed in the limb pocket, so that a notch (that is, the rear end of the arrow) is inserted into the notch insertion hole 220 so as to be easily replaced from an arrow. In addition, a hook portion 219 is formed at the front end of the limb pocket 210 so that the bow can be hung up on an external object such as a bough and the branches of a tree, during hunting.

In addition, a rubber shock absorber 215 that decreases a shock transferred to the bow after discharge of an arrow is provided in the limb pocket 210.

The bow limb 250 is formed of two branches. The front portion of the bow limb 250 is inserted into the insertion groove 214 of the limb pocket 210 and the front end of the bow limb 250 is supported by the lower portion of the front end of the limb pocket 210. The bow limb 250 is extensively formed backwards from the bow while passing the outer side of one end of the upper portion 110 of the bow handle 100. A pulley 400 that rotates around the rotating axis 260 is combined between the rear ends of the two branches of the bow limb 250.

The bow string 450 is an element that is formed between the two pulleys 400 and 500 and is pulled for discharge of an arrow, to thus discharge the arrow using the tension of the bow string 450. One end of the bow string 450 is combined with the end of the upper bow limb 250, so that the bow string 250 is wound on the lower pulley 500 and then wound on the upper pulley 400 again. The other end of the bow string 450 is combined with the end of the lower bow limb 350.

The blade rotating units 800 rotate the blades 200 and 300 to thereby control a distance between the pulleys 400 and 500 and thus control or release tension of the bow string 450, in the case that the bow is disjointed and repaired or tension of the bow string 450 is adjusted. In this embodiment, each of the blade rotating units 800 includes a connection member that connects the limb pocket 210 and the bow handle 100, and a length control member that controls length of the connection member. In addition, each of the length control members comprises a winding unit that rotates an axis 880 that is rotatably combined at one side of the bow handle 100 and winds or releases each of the connection members that is combined with the axis 880 on or from the axis 880. The blade rotating units 800 are installed in the upper and lower portions 110 and 150 of the bow handle 100 in this embodiment, but both the blade rotating units 800 are identical. Accordingly, for convenience of explanation, only the blade rotating unit 800 that is installed in the upper portion 110 of the bow handle 100 will be described below.

As illustrated in FIG. 4, the connection member is formed of two belts 811, in which one end of the belt 811 is combined with the front end of the limb pocket 210 that is extended forwards from the bow handle 100, and the other end of the belt 811 is combined with one end of the extended axis 880 of a worm wheel 860 of a worm gear 850 to be described later, and the two belts 811 are wound on or released from the rotating axis 880 according to rotation of the worm gear 850. The belts 811 that connect the bow blade 200 and the bow handle 100 is formed of two portions separately in this embodiment, but may be formed of a single portion. However, in both cases, an identical effect of the invention can be achieved.

A pin hole (not shown) into which a coupling pin 212 formed in the width direction of the limb pocket 210 is inserted is formed at one end of the belt 811, so as to be combined with the limb pocket 210. The end 815 of the other end of the belt 811 is formed more thickly than the other portions of the belt 811, and safely mounted in a belt fixing groove 882 of the axis 880 of the worm wheel 860. In addition, a rubber shock absorber 813 that decreases a shock transferred to the bow after discharge of an arrow is provided in the belt 811. The upper and lower portions of the rubber shock absorber 813 are combined with the two belts 811. A shock-absorbing hole 813*a* that decreases the shock of the bow is piercingly formed in the rubber shock absorber 813.

Each length control member is a member that is formed at one side of the handle 100, and controls length of the belt 811 that is formed between the handle 100 and the limb pocket 210, to thus rotate the bow blade. In this embodiment, the winding unit includes the worm gear 850 that winds or releases the belts 811 on or from the axis 880.

The worm gear 850 is formed on a worm gear support portion 890 that is formed at one side of the bow handle 100 and includes a worm wheel 860 that winds or releases the belts 811 on or from the axis 880 and a worm 870 that rotates the worm wheel 860. Gear teeth 861 are slantingly formed with respect to the axis 880 on the outer circumferential surface of the worm wheel 860, and the axis 880 is extensively formed bilaterally at the center of the worm wheel 860. Accordingly, both ends of the axis 880 are rotatably combined with both ends 891 of the worm gear support portion 890 whose both ends are protrudes in parallel with each other. In addition, the worm 870 is arranged so that the axis of the worm 870 is perpendicular with the axis 880 of the worm wheel 860. A hexagonal head portion 871 is formed at one end of the worm 870, and threads 872 are formed on the outer circumferential surface of the worm 870. Accordingly, the threads 872 of the worm 870 are tooth-engaged between the gear teeth 861 of the worm wheel 860, to thereby rotate the worm wheel 860.

A belt coupling groove 881 that is piercingly formed from one side of a circular outer circumferential surface of the axis 880 to the other side thereof in the diameter direction is formed at both ends of the extended axis 880 of the worm wheel 860 so that the two belts 811 are combined on both the ends of the extended axis 880 of the worm wheel 860 (refer to FIG. 6), and a belt fixing groove 882 that communicates with the belt coupling groove 881 and whose width is bigger than that of the belt coupling groove 881 is formed at the other side of the outer circumferential surface on which the belt coupling groove 881 is formed so that the end 815 of the belt 811 whose thickness is thicker than the other portions of the belt 811 can be fixed thereto. Accordingly, the end 815 of the belt 811 is safely mounted in the inside of the belt fixing groove 882.

As described above, since the end 815 of the belt 811 that has been combined with the axis 880 of the worm wheel 860 is not protruded outwards from the outer circumferential surface 885 of the axis 880, tension of the bow string 450 is controlled consistently according to rotation of the worm gear 850.

Hereinbelow, an operational process of the compound bow according to the first embodiment of this invention will be described in more detail.

First, as shown in FIG. 2, when a user uses a bow at normal times, the belt 811 is wound on the axis 880 of the worm wheel 860 of the worm gear 850 in some degrees, to thereby make it possible to apply enough tension to discharge an arrow to the bow string 450. In the case of increasing tension of the bow string 450 in this state, to thus intend to strengthen an intensity of the discharged arrow, the worm 870 is rotated by a desired angle in a direction where the belt 811 is wound on the axis 880. In order to rotate the worm 870, a tool such as a wrench is combined with a hexagonal head portion 871 of the worm 870 as an example.

In addition, in the case of disjointing or repairing the bow generally by decreasing tension of the bow string 450 or completely removing tension of the bow string 450, the worm 870 is rotated in a direction where the belt 811 is released from the axis 880. In the case of removing tension of the bow string 450, the bow string 450 can be seceded from the pulleys 400 and 500. Accordingly, it is possible to disjoint or repair the bow generally.

The bow cannot be repaired or disjointed generally without special equipment, since tension of the bow string is kept continuously on the conventional bow in use, but the bow can be repaired or disjointed without special equipment by removing tension of the bow string in this invention. Even in the case that there is a need to replace the bow string with a new one, this invention has an advantage that a user can easily replace the old bow string with a new one.

Meanwhile, in the case of intending to combine the bow string 450 with the bow in order to use it again after having disjointed or repaired the bow, the worm 870 is rotated in a direction where the belt 811 is wound on the axis 880 of the worm wheel 860, until a desired tensile force is applied to the bow string 450.

The upper and lower pulleys 400 and 500 are formed circularly in the drawing of this embodiment, but they can be replaced by various types of the existing eccentric pulleys, eccentric cams, elliptical pulleys, etc., and the bow string can be also linked with the pulleys in various forms.

In addition, the case that a pair of the bow blades 200 and 300 are rotatably combined at both the ends of the bow handle 100, and a pair of the blade rotating units 800 that rotate a pair of the bow blades 200 and 300 are provided has been described in this embodiment, but in an alternative case, a single bow blade can be rotatably combined with the bow handle 100, and a single blade rotating unit 800 that rotates the single bow blade can be provided.

Next, a compound bow according to a second embodiment of this invention will be described below with reference to the drawings.

Figure 8:
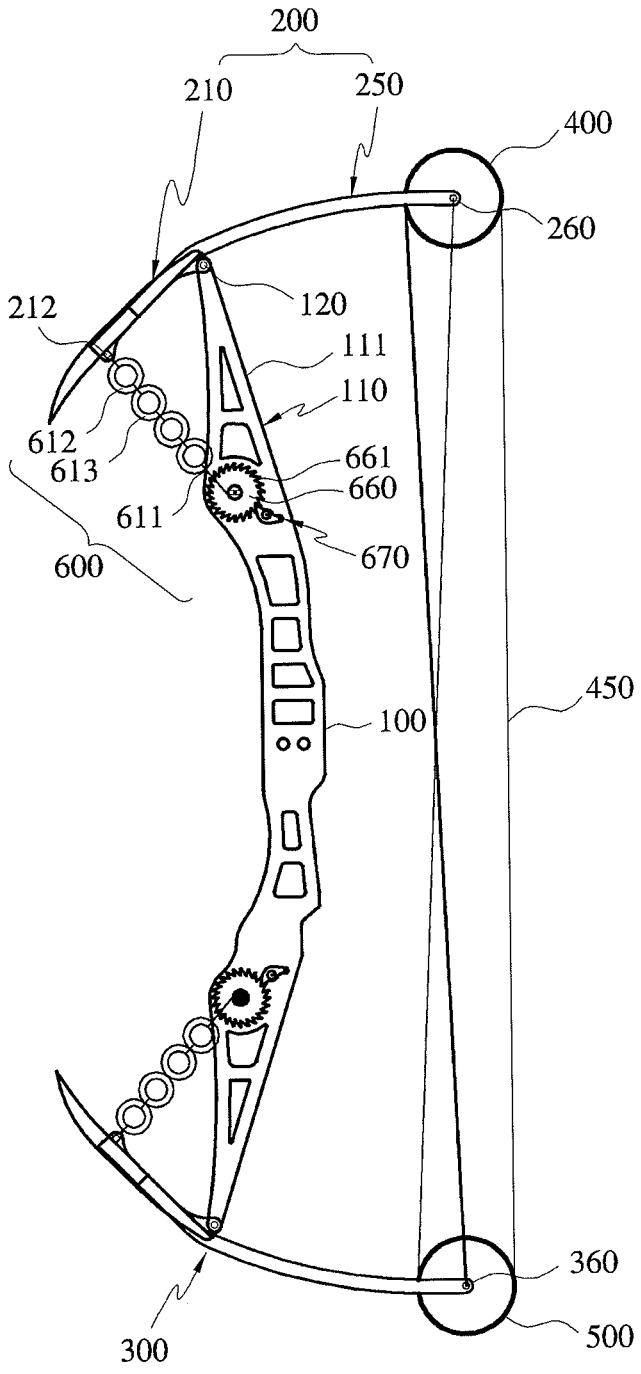
FIG. 8 is a plan view showing a compound bow according to a second embodiment of this invention.
Figure 9:
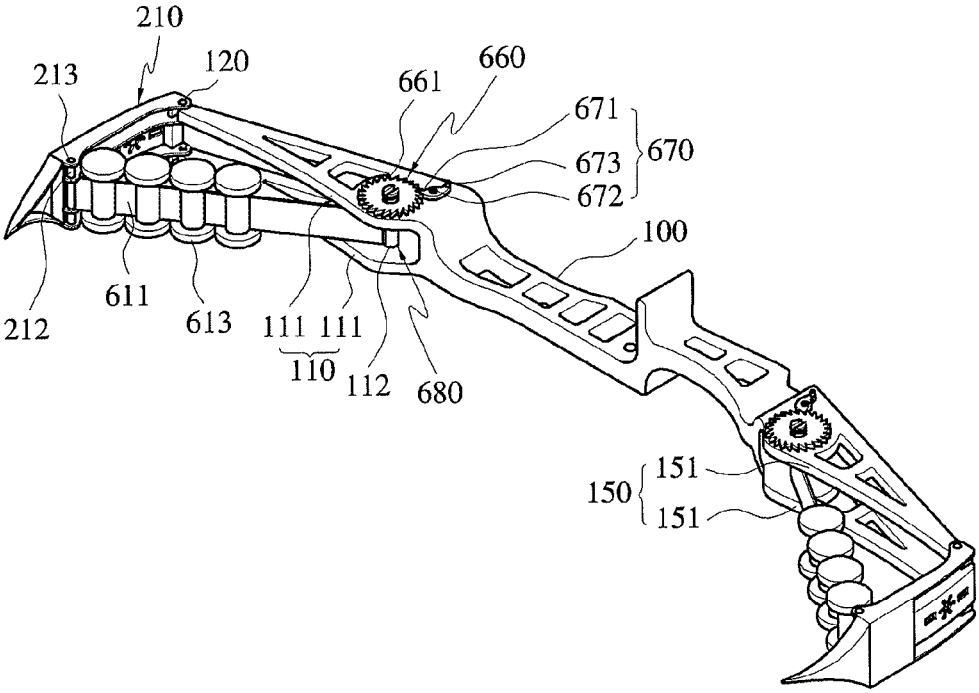
FIG. 9 is a perspective view showing a state where a limb pocket and a bow handle have been assembled in the second embodiment of this invention.
Figure 10:
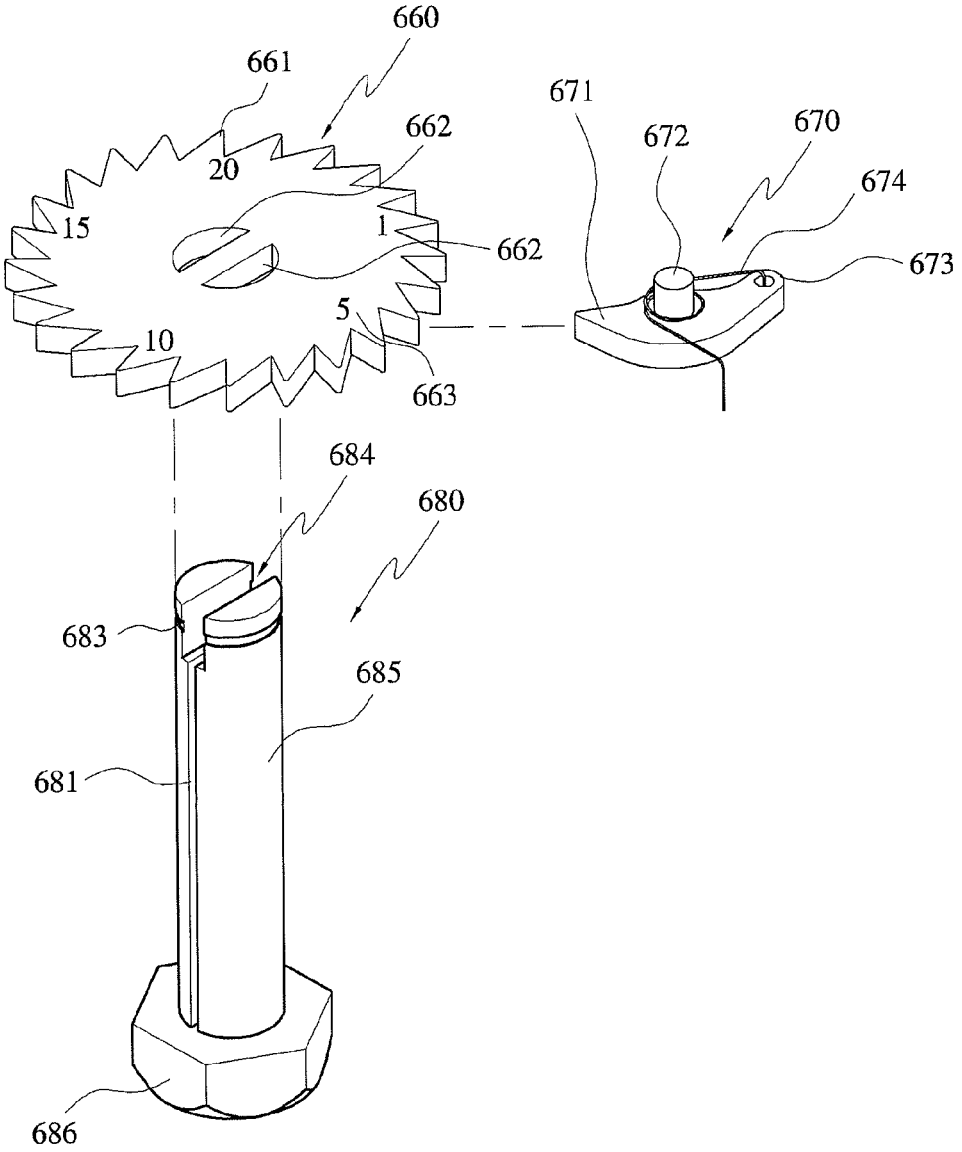
FIG. 10 is a perspective view showing a state where an axial bolt and a ratchet gear are combined in the second embodiment of this invention.
Figure 11:
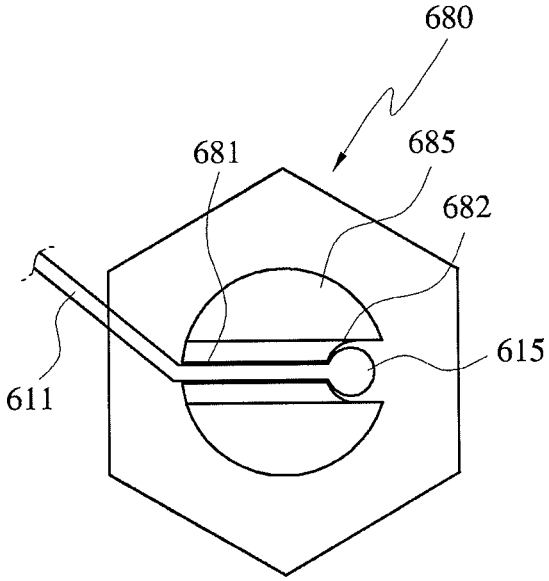
FIG. 11 is a plan view of the axial bolt in the second embodiment of this invention.

FIG. 8 is a plan view showing a compound bow according to a second embodiment of this invention. FIG. 9 is a perspective view showing a state where a limb pocket and a bow handle have been assembled in the second embodiment of this invention. FIG. 10 is a perspective view showing a state where an axial bolt and a ratchet gear are combined in the second embodiment of this invention. FIG. 11 is a plan view of the axial bolt in the second embodiment of this invention. Blade rotating unit 600 that are respectively configured to have a connection member and a length control member in the compound bow according to the second embodiment of this invention differs from that of the first embodiment.

The connection member includes a belt 611 whose one end is combined on the front end of a limb pocket 210 that is extended forwards from the bow handle 100, and whose other end is combined on an axial bolt 680 of a ratchet gear 660 to be described later and that is wound or released on or from the axial bolt 680 as the ratchet gear 660 rotates.

For this purpose, a pin hole (not shown) into which a coupling pin 212 is inserted is formed at one end of the belt 611, so as to be combined with the limb pocket 210. The other end 615 of the belt 611 is formed more thickly than the other portions of the belt 611, and safely mounted in a belt fixing groove 682 of the axial bolt 680 to be described later. In addition, a number of coupling holes 612 are formed in the belt 611, and a number of rubber shock absorbers 613 that decrease a shock transferred to the bow after discharge of an arrow are combined with the coupling holes 612, respectively.

The length control member is a member that is formed at one side of the handle 100, and controls length of the belt 611 that is formed between the handle 100 and the limb pocket 210, to thus rotate the bow blade 200. In this embodiment, a winding unit includes a ratchet gear 660 at the center of which one end of an axial bolt 680 that forms the axis is combined; and a pawl 670 whose one side is tooth-engaged with gear teeth 661 of the ratchet gear 660 so that the ratchet gear 660 rotates only in one direction.

The axial bolt 680 is formed of a cylindrical body. One end of the axial bolt 680 is combined at the center of the ratchet gear 660 and the other end thereof is inserted into an axial bolt support hole 112 that is formed at the upper portion 110 of the bow handle 100, and rotatably supported. The upper portion 110 is divided into two branches 111 formed facing to each other with a certain interval. A hexagonal bolt head 686 is formed at the other end of the axial bolt 680.

One end of the belt 611 is combined on the circular outer circumferential surface 685 of the axial bolt 680 between the two branches 111, and thus the belt 611 is wound on or released from the outer circumferential surface 685 of the axial bolt 680 that is rotated together with rotation of the ratchet gear 660. In addition, a belt coupling groove 681 that is piercingly diametrically formed from one side of the outer circumferential surface 685 of the axial bolt 680 to the other side thereof, so that one end of the belt 611 is inserted thereinto is lengthily formed by a predetermined distance in a lengthy direction of the axial bolt 680. Accordingly, one end of the belt 611 is inserted into the belt coupling groove 681. As illustrated in FIG. 11, a belt fixing groove 682 whose width is bigger than that of the belt coupling groove 681 is formed at one side of the outer circumferential surface 685 on which the belt coupling groove 681 is formed so that the end 615 of the belt 611 whose thickness is thicker than those of the other portions of the belt 611 can be fixed. Accordingly, the end 615 of the belt 611 is safely mounted in the belt fixing groove 682.

Since the end 615 of the belt 611 that has been combined with the axial bolt 680 is not protruded outwards from the outer circumferential surface 685 of the axial bolt 680, tension of the bow string 450 is controlled consistently according to rotation of the ratchet gear 660.

In addition, as illustrated in FIGS. 10 and 11, an incision portion 684 is formed from one end of the belt coupling groove 681 to the outer end of the axial bolt 680 so that one end of the axial bolt 680 is combined with the ratchet gear 660, and the incision portion 684 is formed in the same diametric direction as that of the belt coupling groove 681. Therefore, one end of the axial bolt 680 where the incision portion 684 has been formed is inserted into and combined with an axial bolt insertion hole 662 of the ratchet gear 660, and the end of the axial bolt 680 is protruded outwards from the ratchet gear 660. A safe accommodation groove 683 with which an O-ring is combined is circumferentially formed on the outer circumferential surface 685 of one end of the axial bolt 680 in which the incision portion 684 has been formed, so that the ratchet gear 660 is combined with the axial bolt 680 so as not to secede from the axial bolt 680.

The ratchet gear 660 is formed at one side of the bow handle 100 and operates with the pawl 670 so as to rotate only in one direction. As illustrated in FIG. 10, two arch shaped axial bolt insertion holes 662 face to each other at the center of the ratchet gear 660, so that one end of the axial bolt 680 where the incision portion 684 has been formed is inserted thereinto. In addition, a winding indicator 663 on which turns at predetermined positions between the gear teeth 661 are indicated by numbers is circumferentially formed at the edge of the ratchet gear 660 so as to see a winding degree, in this embodiment. However, rotational angles can be indicated on the winding indicator 663. In addition, the winding indicator 663 may be formed at the peripheral portion of the ratchet gear 660. The pawl 670 is a member that can rotate the ratchet gear 660 only in one direction. One end 671 of the pawl 670 is formed so as to be tooth-engaged between the gear teeth 661 of the ratchet gear 660. In addition, a rotating pin 672 that is combined with the handle 100 is formed at the center of the pawl 670. A pawl handle 673 that rotates the pawl 670 by a predetermined angle around the rotating pin 672 and makes the pawl 670 tooth-engaged or released between the gear teeth 661 of the ratchet gear 660 is formed at the other end of the pawl 670. In addition, a spring 674 is provided on the pawl 670. One end of the spring 674 is combined with the bow handle 100, and the other end thereof is combined with the pawl handle 673. Thus, the spring 674 plays a role of making the pawl 670 tooth-engaged with the gear teeth 661 of the ratchet gear 660 again after the pawl 670 is seceded from the gear teeth 661 of the ratchet gear 660.

Hereinbelow, an operational process of the compound bow according to the second embodiment of this invention will be described in more detail.

First, as shown in FIG. 8, when a user uses a bow at normal times, the belt 611 is wound on the axial bolt 680 of the ratchet gear 660 in some degrees, to thereby make it possible to apply enough tension to discharge an arrow to the bow string 450. In this state, a force of rotating the ratchet gear 660 in a direction where the belt 611 is released is applied to the ratchet gear 660 by tension of the bow string 450, and the pawl 670 is tooth-engaged with the gear teeth 661 of the ratchet gear 660, to thereby prevent the ratchet gear 660 from being rotated in the direction where the belt 611 is released. In the case of increasing tension of the bow string 450 in this state, to thus intend to strengthen an intensity of the discharged arrow, the ratchet gear 660 is rotated by a desired angle in a direction where the belt 611 is wound on the axial bolt 680, and then the pawl 670 is tooth-engaged between the gear teeth 661 of the ratchet gear 660. In order to rotate the ratchet gear 660, a tool such as a wrench or spanner is inserted into a hexagonal head portion 686 of the axial bolt 680 as an example.

In addition, in the case of disjointing or repairing the bow generally by decreasing tension of the bow string 450 or completely removing tension of the bow string 450, the ratchet gear 660 is rotated a little in a direction where the belt 611 is wound on the axial bolt 680, to thus make the pawl 670 seceded from the gear teeth 661 of the ratchet gear 660. Then, the ratchet gear 660 is rotated in a direction where the belt 611 is released from the axial bolt 680, to thereby decrease or completely remove tension of the bow string 450. In the case of removing tension of the bow string 450, the bow string 450 can be seceded from the pulleys 400 and 500. Accordingly, it is possible to disjoint or repair the bow generally.

Meanwhile, in the case of intending to combine the bow string 450 with the bow in order to use it again after having disjointed or repaired the bow, the ratchet gear 660 is rotated in a direction where the belt 611 is wound on the axial bolt 680, until a desired tensile force is applied to the bow string 450 and then the pawl 670 is tooth-engaged between the gear teeth 661 of the ratchet gear 660 lest the belt 611 should be released from the axial bolt 680, to thereby use the compound bow.

Figure 12:
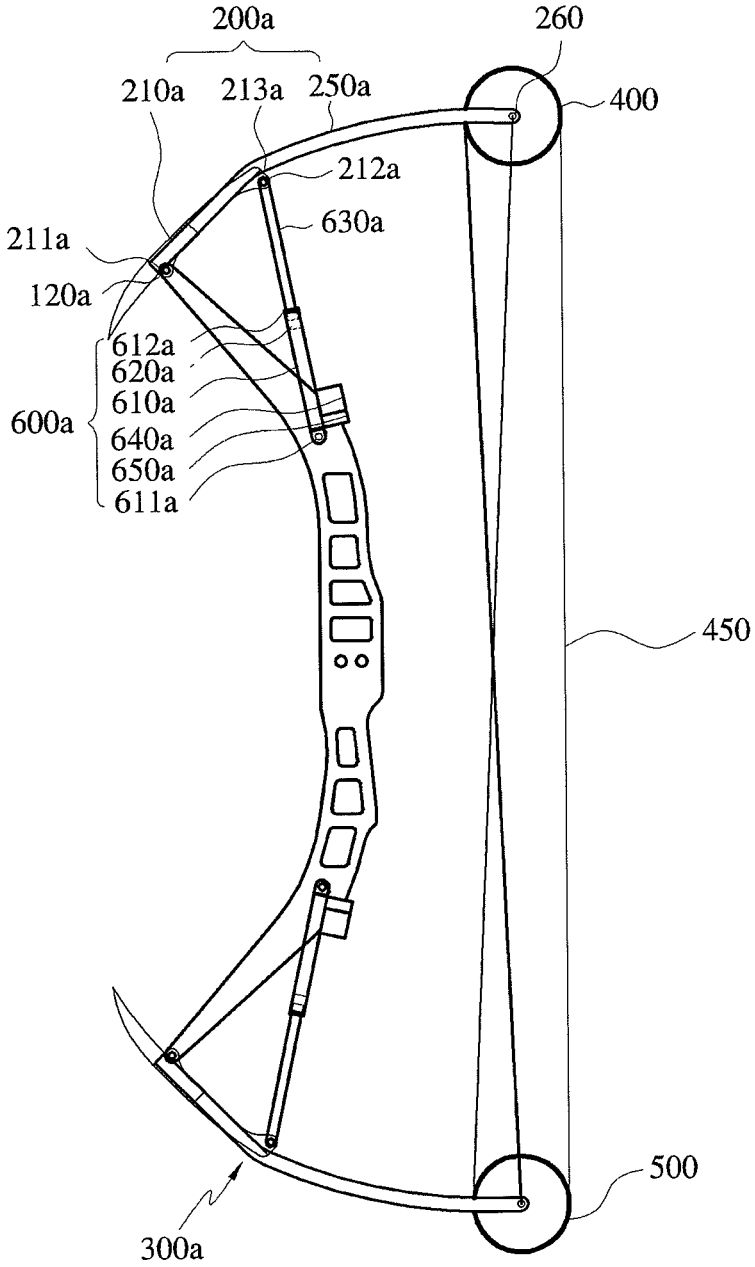
FIG. 12 is a plan view of a compound bow according to a third embodiment of this invention.

Next, a compound bow according to a third embodiment of this invention will be described below with reference to the drawings. FIG. 12 is a plan view of a compound bow according to a third embodiment of this invention.

A difference point between the compound bow according to the first embodiment of the present invention and that of the third embodiment of thereof will be described below.

The bow blade 200*a* of a pair of the bow blades 200*a* and 300*a* is rotatably combined with one end of the bow handle 100, and is extensively formed in the rear side of the bow handle 100. Each of the bow blades 200*a* and 300*a* includes: a limb pocket 210*a* whose one end is rotatably combined on one end of the bow handle 100, and that is extensively formed at one end of the bow handle 100 in the rear side of the arrow; and a bow limb 250*a* whose one end is combined with the limb pocket 210*a* and that is extensively formed backwards from the bow, and on the other end of which a rotating axis 260 combined with a pulley 400 is formed.

A rotating pin hole 211*a* into which a rotating pin 120*a* that is formed at one end of the handle 100 is inserted is formed in the lower side of the front end of the limb pocket 210*a*, so that the front end of the limb pocket 210*a* is rotatably combined with the upper end of the handle 100, and the rear end of the limb pocket 210*a* is extensively formed backwards from an arrow (in a direction opposing an arrow traveling direction, that is, backwards from the bow handle 100). A coupling pin hole 213*a* is formed in the rear end of the limb pocket 210*a*. Here, a combined coupling pin 212*a* combined with the other end of a piston rod 630*a* is inserted into the coupling pin hole 213*a*. In addition, an insertion groove 214 is formed in the lengthy direction in the same manner as that of the first embodiment of the present invention (refer to FIG. 5), so that the front side of the bow limb 250*a* is inserted into the limb pocket 210*a*, and the front side of the bow limb 250*a* is inserted into an insertion groove 214 and the front side of the bow limb 250*a* is supported at the lower-front portion of the limb pocket 210*a*.

The front side of the bow limb 250*a* is inserted into an insertion groove 214 of the limb pocket 210*a*. Accordingly, the front end of the limb pocket 210*a* is supported at the lower-front portion of the limb pocket 210*a*, and is extensively formed in the rear side of the arrow while passing the upper side of one end of a piston rod 630*a*. Pulleys 400 that are rotatably combined around the rotating axis 260 are rotatably combined at the rear end of the bow limb 250*a*.

In addition, the blade rotating unit 600*a* that rotates the bow blade 200*a* in this embodiment of the present invention includes: a cylinder 610*a* whose one end 611*a* is rotatably combined with one side of the bow handle 100, and that has an inner space to or from which fluid such as gas or oil is supplied or discharged, by a fluid supply unit that supplies or discharges the fluid such as gas or oil; a circular plate type piston 620*a* that is placed in the inner space of the cylinder 610*a* and that is moved in the lengthy direction of the cylinder 610*a* according to a supply or discharge of the fluid to or from the cylinder 610*a*; and a piston rod 630*a* whose one end is fixedly combined with the piston 620*a* and whose other end is extensively formed outwards from the cylinder 610*a* through the other end of the cylinder 610*a*, and that is rotatably combined with one side of the bow blade 200*a* that is extended in the rear side of the bow handle 100, that is, with the other end of the limb pocket 210*a*.

A small hydraulic oil pump 640*a* having a battery 650*a* is provided at one side of the cylinder 610*a* as the fluid supply unit in this embodiment of the present invention. Oil is supplied to or discharged from the cylinder 610*a* through an oil exit (not shown).

Since the other components of the third embodiment of the present invention are the same as those of the previous first and second embodiments of the present invention, the detailed description thereof will be omitted.

A method of using the compound bow according to the third embodiment of the present invention having the above-described structure will be described below in more detail. Oil has been filled in the cylinder 610*a* in a state where a certain tension has been applied to the bow string 450 so that a user can launch an arrow at normal times. In the case of intending to increase tension of the bow string 450 in this state, the hydraulic oil pump 640*a* including oil is made to operate so that oil is supplied into the cylinder 610*a* to thus increase pressure in the cylinder 610*a*. Accordingly, the bow blade 200*a* is made to rotate in a direction where a piston rod 630*a* increases distance between the pulleys 400 and 500, to thereby increase tension of the bow string 450.

In contrary, in the case of decreasing or removing tension of the bow string 450 in order to dismantle the compound bow, oil is made to drain from the cylinder 610*a* in order to decrease pressure in the cylinder 610*a*. Accordingly, the bow blade 200*a* is made to rotate in a direction where a piston rod 630*a* decreases distance between the pulleys 400 and 500, to thereby decrease tension of the bow string 450.

Even in the case of completely removing tension of the bow string 450 to thus dismantle or repair the bow and then restore it again into the state of the bow at use, pressure in the cylinder 610*a* is increased by the hydraulic oil pump 640*a* in the same manner as that of increasing tension of the bow string 450 as described above. Accordingly, the piston rod 630*a* is withdrawn from the cylinder 610*a* to thus increase tension of the bow string 450.

The hydraulic oil pump has been illustrated as the fluid supply unit in the cylinder 610*a*, but any unit such as a hydraulic jack or air pump that can supply gas or oil into the cylinder 610*a* to thereby increase pressure of fluid in the cylinder 610*a* and to thus withdraw the piston rod 630*a* can be applied as the fluid supply unit in the cylinder 610*a*.

Figure 13:
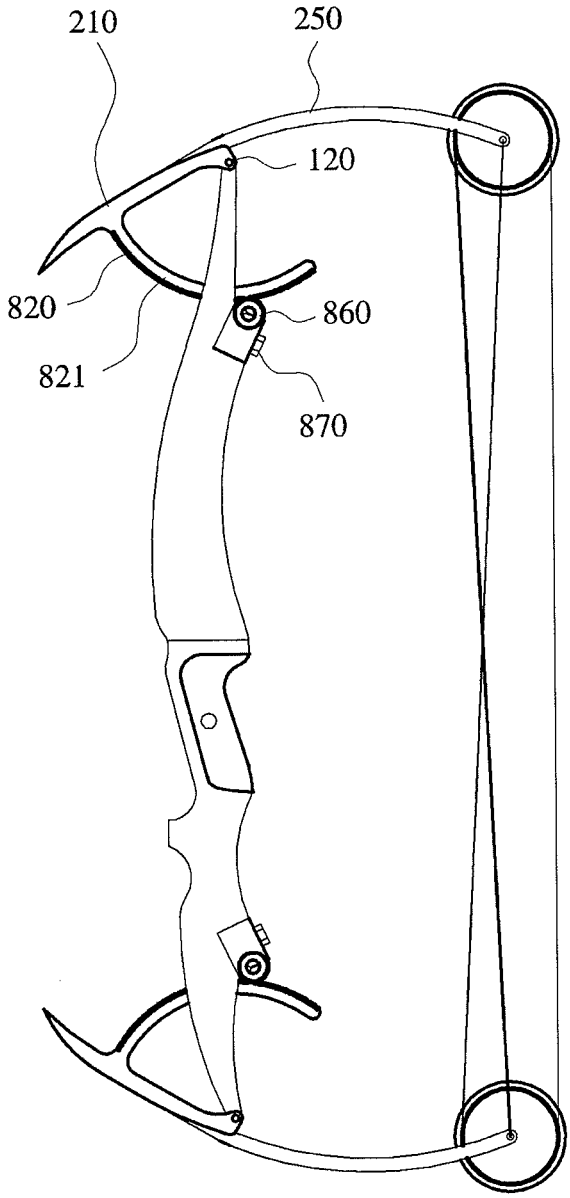
FIG. 13 is a plan view of a compound bow according to a fourth embodiment of this invention.

Next, a compound bow according to a fourth embodiment of this invention will be described below with reference to the drawings. FIG. 13 is a plan view of a compound bow according to a fourth embodiment of this invention.

A difference point between the compound bow according to the first embodiment of the present invention and that of the fourth embodiment of thereof will be described below.

A connection member that connects a limb pocket 210 with a bow handle 100 in a structure of a blade rotating unit does not employ the belt 811 but an arch portion 820 that is extended downwards in an arc form from the lower surface of the front end of the limb pocket 210 and on the outer circumferential surface of which gear teeth 821 that are tooth-engaged with gear teeth 861 of the worm wheel 860 are formed.

In the case of the compound bow according to the fourth embodiment of this invention having the above-described composition, the worm wheel 860 is rotated according to rotation of the worm 870 (Worm wheel 860 and worm 870 of this embodiment are identical to those of the first embodiment. Refer to FIG. 7). As a result, the gear teeth 821 of the arch portion 820 are tooth-engaged with those of the worm wheel 860, to thus make the limb pocket 210 rotate around the rotating pin 120. Therefore, the bow limb 250 combined with the limb pocket 210 is made to rotate. Thus, tension of the bow string 450 can be controlled or cancelled so that the compound bow can be easily dismantled or assembled. Since the other components of the fourth embodiment of the present invention are the same as those of the previous first embodiment of the present invention, the detailed description thereof will be omitted.

Figure 14:
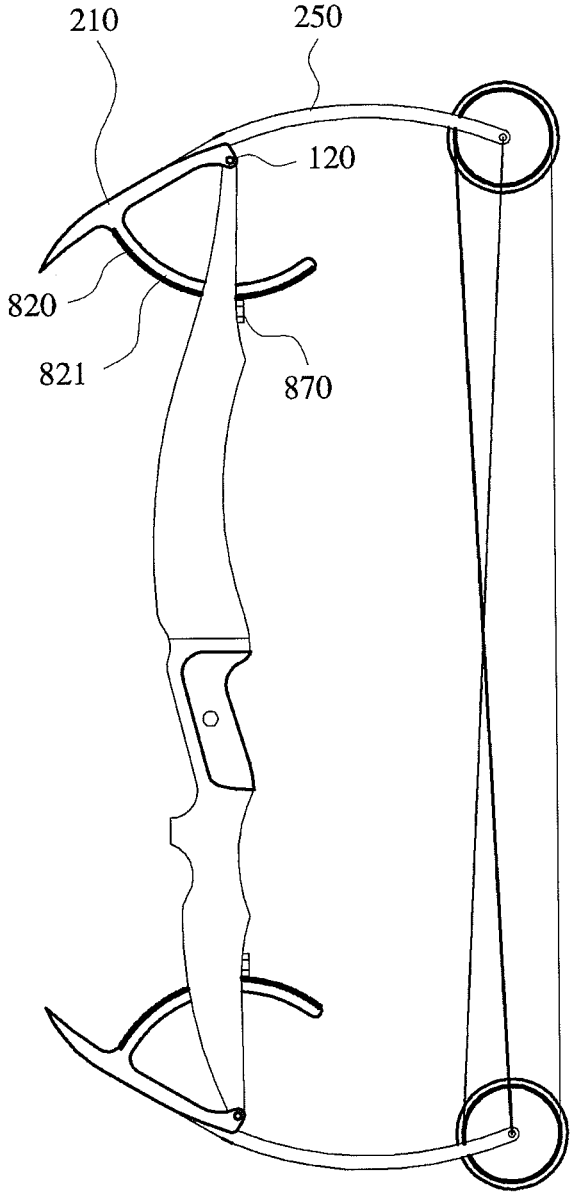
FIG. 14 is a plan view of a compound bow according to a fifth embodiment of this invention.

Next, a compound bow according to a fifth embodiment of this invention will be described below with reference to the drawings. FIG. 14 is a plan view of a compound bow according to a fifth embodiment of this invention.

A difference point between the compound bow according to the fourth embodiment of the present invention and that of the fifth embodiment of thereof will be described below.

The case that the worm wheel 860 is rotated according to rotation of the worm 870, and thus the gear teeth 821 of the arch portion 820 are tooth-engaged with those of the worm wheel 860, to thus make the limb pocket 210 make the rotating pin 120 axially rotate, has been described in the fourth embodiment of the present invention, but no worm wheel exists in the fifth embodiment of the present invention and accordingly threads 872 of a worm 870 whose axis is formed in parallel with a tangential direction of the arch portion 820 are tooth-engaged with gear teeth 821 of the arch portion 820. Since coupling of the worm 870 with the arch portion 820 in the fifth embodiment of the present invention is the same as that between the worm 870 and the worm wheel 860 in the first embodiment of the present invention, the detailed description and drawing thereof will be omitted here.

In the case of the compound bow according to the fifth embodiment of this invention having the above-described composition, the arch portion 820 that are tooth-engaged with the threads of the worm 870 according to rotation of the worm 870, is axially rotated. As a result, the bow limb 250 combined with the limb pocket 210 is made to rotate. Thus, tension of the bow string 450 can be controlled or cancelled so that the compound bow can be easily dismantled or assembled. Since the other components of the fifth embodiment of the present invention are the same as those of the previous fourth embodiment of the present invention, the detailed description thereof will be omitted.

Figure 15:
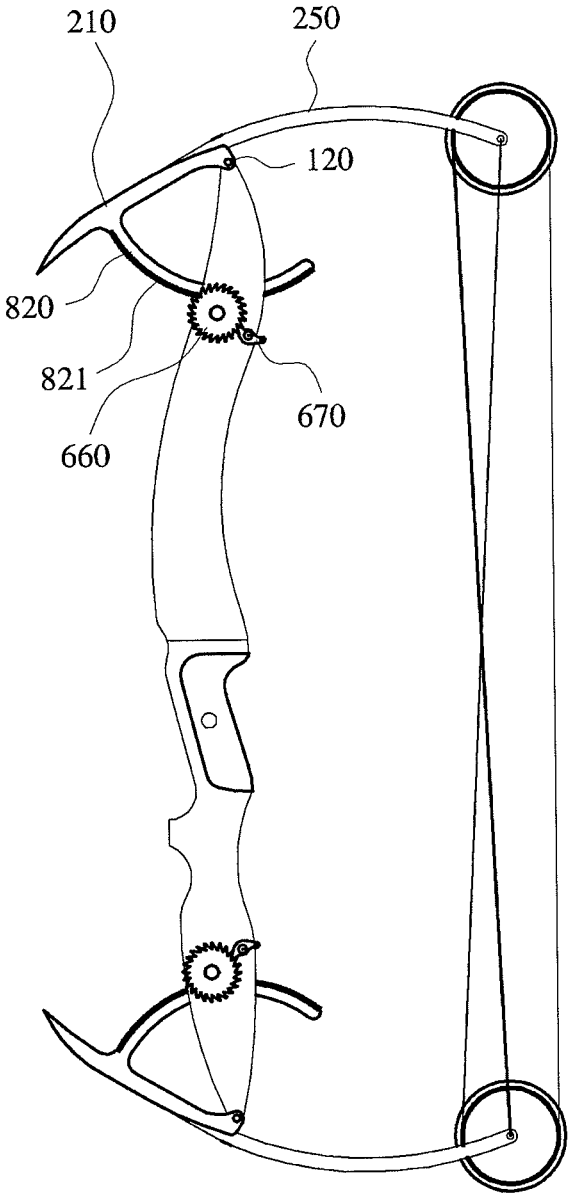
FIG. 15 is a plan view of a compound bow according to a sixth embodiment of this invention.
Figure 16:
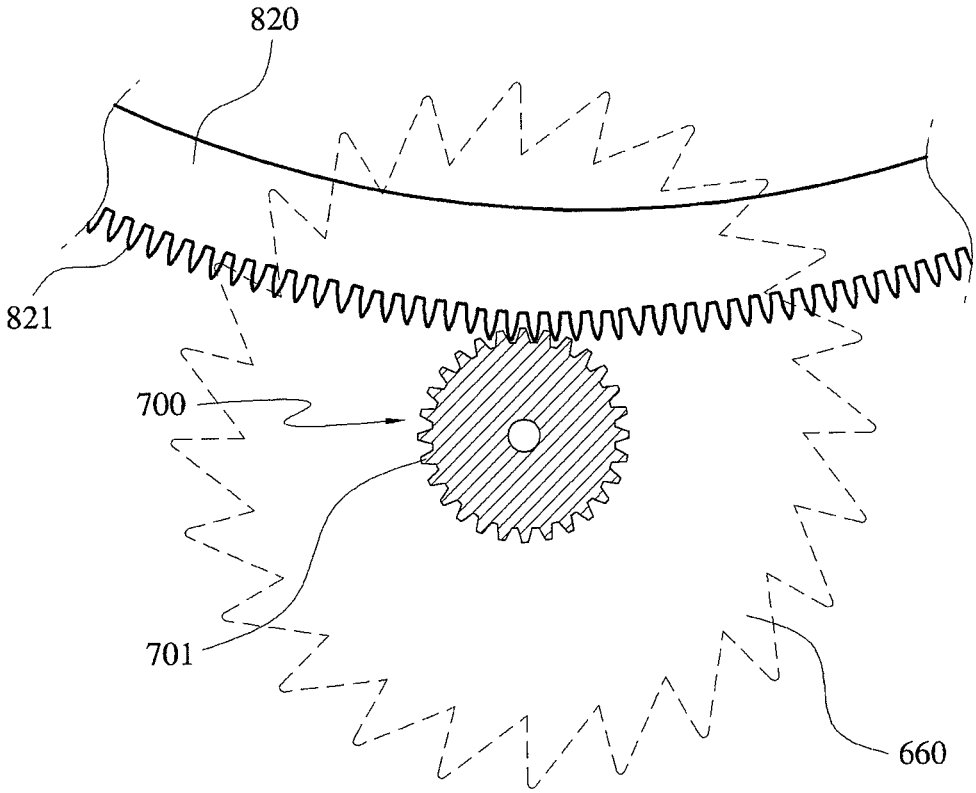
FIG. 16 is a diagram illustrating a coupling relationship between an arch portion and a rotating wheel in the sixth embodiment of this invention.

Next, a compound bow according to a sixth embodiment of this invention will be described below with reference to the drawings. FIG. 15 is a plan view of a compound bow according to a sixth embodiment of this invention, and FIG. 16 is a diagram illustrating a coupling relationship between an arch portion 820 and a rotating wheel 700 in the sixth embodiment of this invention.

A difference point between the compound bow according to the sixth embodiment of the present invention and that of the fifth embodiment of thereof will be described below.

The case that the threads 872 of a worm 870 whose axis is formed in parallel with a tangential direction with respect to the outer circumferential surface of the arch portion 820 are tooth-engaged with the gear teeth 821 of the arch portion 820, and thus the arch portion 820 is rotated according to rotation of the worm 870, has been described in the fifth embodiment of this invention, but the bow blade 200 is rotated according to rotation of the rotating wheel 700 that is rotatably combined at one side of the bow handle 100 and is disposed in parallel with the rotating pin 120 that forms the rotational axis of the bow blade 200, instead of the worm 870, in the sixth embodiment of this invention. That is, the rotating wheel 700 on the outer circumferential surface of which the gear teeth 701 that are tooth-engaged with the gear teeth 821 of the arch portion 820 are formed, rotates the arch portion 820. In addition, a ratchet gear 660 that is formed at one side of the bow handle 100 coaxially with respect to the rotating wheel 700, and a pawl 670 whose one side is tooth-engaged with gear teeth 661 of the ratchet gear 660 so that the ratchet gear 660 rotates only in one direction, are further provided at one end of the rotating wheel 700. When the pawl 670 has been tooth-engaged with the ratchet gear 660 as described in the second embodiment of the present invention, the rotating wheel 700 can be rotated in a direction where the front end of the limb pocket 210 approaches toward the bow handle 100, but can be prevented from being rotated in a direction where the front end of the limb pocket 210 goes far away from the bow handle 100, to thereby play a role of keeping tension of the bow string 450 during use of the bow.

In the case of the compound bow according to the sixth embodiment of this invention having the above-described composition, a spanner and so on is combined on a hexagon head portion (not shown) that is formed at one side of the rotating wheel 700, to thereby make the rotating wheel 700. The arch portion 820 rotates around the rotating pin 120 according to rotation of the rotating wheel 700. As a result, the bow limb 250 combined with the limb pocket 210 is made to rotate in the bow blade 200. Thus, tension of the bow string 450 can be controlled or cancelled so that the compound bow can be easily dismantled or assembled. Since the other components and functions of the sixth embodiment of the present invention are the same as those of the previously described embodiments of the present invention, the detailed description thereof will be omitted. The ratchet gear 660 and the pawl 670 play a role of fixing the rotating wheel 700 during use of the bow as described above.

Figure 17:
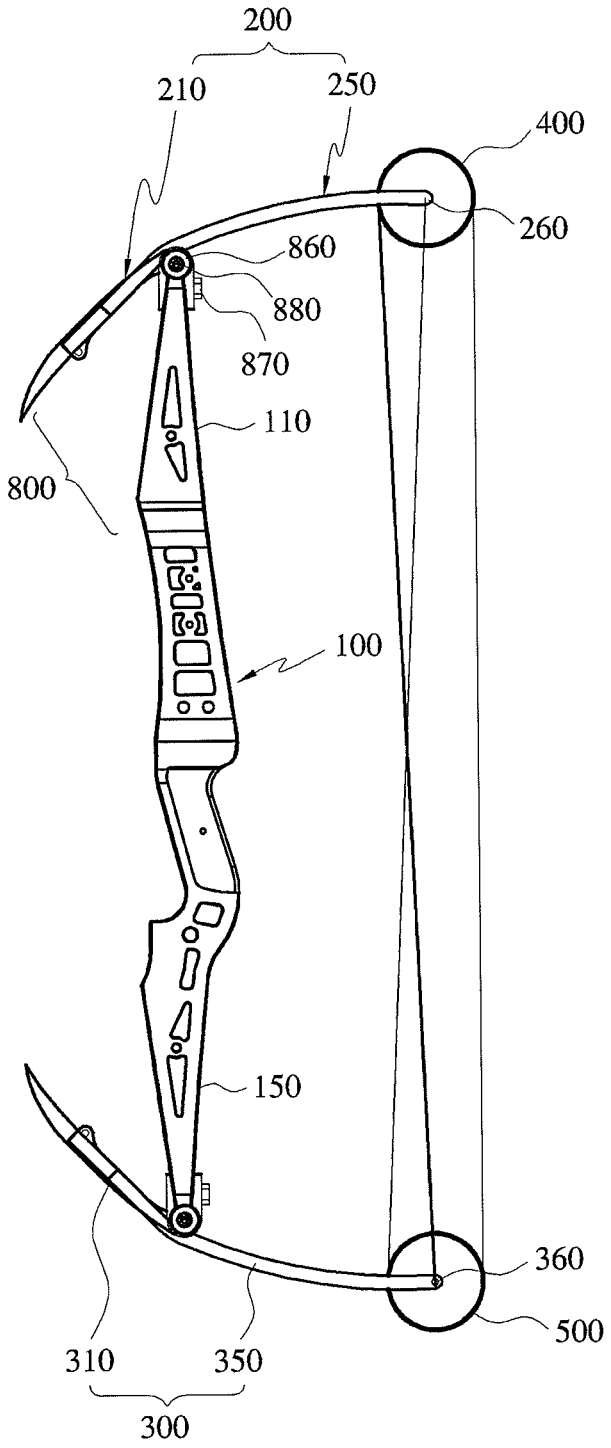
FIG. 17 is a plan view of a compound bow according to a seventh embodiment of this invention.

FIG. 17 is a plan view of a compound bow according to a seventh embodiment of this invention.

A difference point between the compound bow according to the seventh embodiment of the present invention and that of the first embodiment of thereof will be described below. No connection member that connects a limb pocket 210 with a bow handle 100 is employed in a structure of a blade rotating unit. Instead, a worm gear rotates the bow blade 200 directly. That is, the worm gear is formed at one end of the upper portion 110 of the bow handle 100, and the rear end of the limb pocket 210 is combined on an axis 880 of the worm wheel 860 that replaces the rotating pin 120 in the first embodiment of the present invention. Accordingly, the limb pocket 210 rotates together according to rotation of the axis 880 of the worm wheel 860 (Worm wheel 860 and worm 870 of this embodiment are identical to those of the first embodiment. Refer to FIG. 7).

In the case of the compound bow according to the seventh embodiment of this invention having the above-described composition, the limb pocket 210 is rotated with the axis 880 of the worm wheel 860. As a result, the bow limb 250 combined with the limb pocket 210 is made to rotate. Thus, tension of the bow string 450 can be controlled or cancelled so that the compound bow can be easily dismantled or assembled. Since the other components of the seventh embodiment of the present invention are the same as those of the previous embodiments of the present invention, the detailed description thereof will be omitted.

The upper and lower pulleys 400 and 500 are formed circularly in the drawing of these embodiments of the present invention, but they can be replaced by various types of the existing eccentric pulleys, eccentric cams, elliptical pulleys, etc., and the bow string can be also linked with the pulleys in various forms.

In addition, the case that a pair of the bow blades are rotatably combined at both the ends of the bow handle 100, and a pair of the blade rotating units that rotate a pair of the bow blades are provided has been described in these embodiments of the present invention, but in an alternative case, a single bow blade can be rotatably combined with the bow handle 100, and a single blade rotating unit 800 that rotates the single bow blade can be provided to thus identically obtain the effect of the present invention.

Although the present invention has been described in detail with respect to the limited embodiments and drawings, it is not limited thereto. It is apparent to one who has an ordinary skill in the art that there may be a number of modifications and variations within the same technical spirit of the invention. It is natural that the modifications and variations belong to the following appended claims.

What is claimed is:

1. A compound bow comprising:

a bow handle adapted to be held by a user with his or her hand;

a pair of bow blades combined with both ends of the bow handle, at least one bow blade being rotatably combined with the bow handle;

a pair of pulleys rotatably combined with respective rear ends of the pair of the bow blades so as to rotate around a rotating axis of each pulley;

a bow string formed between the pair of the pulleys and pulled for discharge of an arrow; and a blade rotating unit that rotates the bow blade rotatably combined with the bow handle, in order to adjust or release tension of the bow string by adjusting distance between the pair of the pulleys in the case of controlling the tension of the bow string or disjointing or repairing the bow;

the blade rotating unit comprising:

a connection member of which the one end is combined with one end of the bow blade, and the other end is combined with one side of the bow handle; and a length control member that controls length of the connection member;

the length of the connection member formed between one end of the bow blade and the bow handle is controlled by the length control member.

2. The compound bow according to claim 1, wherein the pair of the bow blades are rotatably combined around rotating axes that are formed at both ends of the bow handle, and a pair of blade rotating units are provided to rotate the pair of the bow blades, respectively.

3. The compound bow according to claim 1, wherein the one end of the connection member is combined with a pin that is formed in the width direction of the bow blade.

4. The compound bow according to claim 1, wherein the length control member comprises a winding unit that rotates an axis that is rotatably combined at one side of the bow handle and winds or releases the connection member that is combined with the axis on or from the axis.

5. The compound bow according to claim 4, wherein the winding unit of the length control member comprises: a worm wheel at the center of which the axis is combined; and a worm that rotates the worm wheel in which threads that are formed on the outer circumferential surface of the worm are tooth-engaged with gear teeth that are formed on outer circumferential surface of the worm wheel, and wherein the connection member comprises a belt whose one end is combined on one side of the bow blade that is extended forwards from the bow handle, and whose other end is combined on one end of the axis of the worm wheel and that is wound or released on or from the axis as the worm gear rotates.

6. The compound bow according to claim 5, wherein a rubber shock absorber that decreases a shock transferred to the bow after discharge of an arrow is provided in the belt.

7. The compound bow according to claim 6, wherein a shock-absorbing hole that decreases the shock of the bow is piercingly formed in the rubber shock absorber.

8. The compound bow according to claim 5, wherein a belt coupling groove that is piercingly formed transversely in the diameter direction from one side of the outer circumferential surface of the axis to the other side thereof is formed at one end of the axis of the worn wheel, so that the other end of the belt is fitted into the belt coupling groove.

9. The compound bow according to claim 8, wherein a belt fixing groove that communicates with the belt coupling groove and whose width is larger than that of the belt coupling groove is formed at the other side of the axis of the worm wheel, in which an end portion of the belt whose thickness is thicker than the other portion of the belt is safely mounted in the inside of the belt fixing groove so as not to be protruded outwards from the outer circumferential surface of the axis of the worm wheel.

10. The compound bow according to claim 5, wherein the bow blade that is rotatably combined with the bow handle, comprises:

a limb pocket whose one end is rotatably combined around a rotating axis that is formed at one end of the bow handle and that is extensively formed forwards from one end of the bow handle; and a bow limb whose one end is combined with the limb pocket and that is extensively formed backwards from the bow, and on the other end of which a rotating axis with which a pulley is combined is formed.

11. The compound bow according to claim 10, wherein an insertion groove is lengthily formed in the limb pocket so as to allow the front side of the bow limb to be inserted into the insertion groove.

12. The compound bow according to claim 10, wherein a coupling pin that is combined with one end of the belt is formed at one end of the front side of the limb pocket, in which a pin hole that is formed at one end of the belt is combined in one side of the coupling pin.

13. The compound bow according to claim 10, wherein a rubber shock absorber that decreases a shock transferred to the bow after discharge of an arrow is provided in the limb pocket.

14. The compound bow according to claim 10, wherein an arrowhead insertion hole into which an arrowhead is inserted so as to be disjointed from or combined with an arrow, and an arrowhead wing insertion portion that has one or more arrowhead wing insertion hole that is extended bilaterally from the arrowhead insertion hole and into which one or more arrowhead wings are inserted, are formed in the limb pocket.

15. The compound bow according to claim 10, wherein a notch insertion hole is formed in the limb pocket, so that a notch is inserted into the notch insertion hole so as to be easily replaced from an arrow.

16. The compound bow according to claim 10, wherein a hook portion is formed at the front end of the limb pocket so that the bow can be hung up on an external object.

* * * * *